US006578884B2

(12) United States Patent
Chiang

(10) Patent No.: US 6,578,884 B2
(45) Date of Patent: Jun. 17, 2003

(54) LATCH ASSEMBLY ADAPTED TO BE MOUNTED ON A RECESSED DOOR OF A CABINET FOR CLOSING THE SAME

(76) Inventor: Ching-Hua Chiang, No. 48, 39th Rd., Industrial Park, Taichung City (TW)

( * ) Notice: Subject to any disclaimer, the term of this patent is extended or adjusted under 35 U.S.C. 154(b) by 0 days.

(21) Appl. No.: 10/135,922

(22) Filed: Apr. 30, 2002

(65) Prior Publication Data

US 2002/0167181 A1 Nov. 14, 2002

(30) Foreign Application Priority Data

May 11, 2001 (TW) ..... 90207753 U

(51) Int. Cl.[7] ..... E05C 5/00

(52) U.S. Cl. ..... 292/66; 292/358; 292/DIG. 64; 292/200

(58) Field of Search ..... 292/66, 350, 358, 292/200, 217, 226, 232, 236, DIG. 53, DIG. 64

(56) References Cited

U.S. PATENT DOCUMENTS 461,975 A * 10/1891 Davis
1,308,325 A * 7/1919 Bird
3,402,958 A * 9/1968 Barry ..... 292/62
4,226,454 A * 10/1980 Tranberg ..... 292/336.5
4,381,656 A * 5/1983 Hayakawa ..... 70/451
4,763,935 A * 8/1988 Bisbing ..... 292/66
4,930,822 A * 6/1990 Shen ..... 292/357
5,685,584 A * 11/1997 Baren ..... 292/358
5,931,035 A * 8/1999 Bolton ..... 70/367

* cited by examiner

*Primary Examiner*—Gary Estremsky
(74) *Attorney, Agent, or Firm*—Christensen O'Connor Johnson Kindness PLLC

(57) ABSTRACT

A latch assembly includes a casing defining a lever chamber and a spring chamber and having a wall interposed between the lever chamber and the spring chamber and formed with a shaft-extension hole to permit extension of a coupler shaft therethrough such that a pivot portion of the shaft extends into the lever chamber and a threaded portion of the shaft is disposed outwardly of the spring chamber. The threaded portion is formed with a pair of axially aligned grooves. A coupler portion of a latch member is formed with a shaft hole confined by a hole-confining wall for extension of the threaded portion therethrough, and a pair of engaging tongues that extend inwardly and radially from the hole-confining wall and that slidably and respectively engage the slots in the shaft so as to permit sliding movement of the latch member along the length of the shaft and so as to facilitate mounting and removal of the latch member on and from the shaft.

2 Claims, 7 Drawing Sheets

LATCH ASSEMBLY ADAPTED TO BE MOUNTED ON A RECESSED DOOR OF A CABINET FOR CLOSING THE SAME

CROSS REFERENCE TO RELATED APPLICATION

This application claims priority of Taiwan Application No. 90207753, filed on May 11, 2001.

BACKGROUND OF THE INVENTION

1. Field of the Invention

The invention relates to a latch assembly, more particularly to a latch assembly that is adapted to be mounted on a recessed door of a cabinet, such as a fuse cabinet, for closing the same.

2. Description of the Related Art

Referring to FIGS. 1 and 2, a conventional latch assembly is shown to include a casing 10, a coupler shaft 24, a latch member 30, a pair of fastener nuts 33, a locking plate 28, an urging member 27, a pivot pin 25, and a lever 21.

As illustrated, the casing 10 is mounted on a recessed door P of a cabinet (not shown) via a U-shaped bracket 41 and a mounting bolt 42, includes a peripheral wall 101 defining a lever chamber 11 and having a front open end 109 for access to the lever chamber 11. The casing 10 further includes a rear wall 102 confining a rear side of the lever chamber 11, and a spring-confining flange 103 that projects rearwardly from the rear wall 102 to define a spring chamber 105. The rear wall 102 is formed with a shaft-extension hole 102" in spatial communication with the spring chamber 105 and the lever chamber 11.

The coupler shaft 24 extends in a longitudinal direction, is disposed movably and rotatably in the casing 10, and passes through the shaft-extension hole 102" in the rear wall 102. The coupler shaft 24 has a threaded portion 242 that is disposed outwardly and rearwardly of the spring chamber 105, and a pivot portion 241 that extends into the lever chamber 11 and that is formed with a pin-hole 241". The coupler shaft 24 is rotatable about an axis.

The latch member 30 has a coupler portion 31 that is formed with a threaded shaft hole 311 for extension of the threaded portion 242 of the coupler shaft 24 therethrough. The threaded shaft hole 311 is confined by a threaded inner face that threadedly engages the threaded portion 242 of the coupler shaft 24. The nuts 33 are disposed at two opposite sides of the coupler portion 31 of the latch member 30 via two washers 32, and threadedly engage the threaded portion 242 of the coupler shaft 24 so as to secure the latch member 30 on the coupler shaft 24 and so as to permit co-rotation of the latch member 30 and the coupler shaft 24 about the axis and co-movement of the latch member 30 and the coupler shaft 24 in the longitudinal direction.

The locking plate 28 is fastened securely to the pivot portion 241 of the coupler shaft 24 via a fastener nut 29 for co-movement with the coupler shaft 24 in the longitudinal direction between an engaging position, in which, the locking plate 28 extends into the spring chamber 105 and releasably engages the flange 103, thereby preventing rotation of the coupler shaft 24 about the axis in the spring chamber 105, and a disengaging position, in which, the locking plate 28 moves outwardly of the spring chamber 105 to disengage from the flange 103, thereby permitting rotation of the coupler shaft 24 about the axis.

The urging member 27 is disposed in the spring chamber 105 for constantly urging the locking plate 28 and the coupler shaft 24 to move away from the spring chamber 105.

The pivot pin 25 is disposed in the lever chamber 11, and extends in a transverse direction relative to the longitudinal direction, and through the pin-hole 241" in the coupler shaft 24.

The lever 21 extends in a vertical direction transverse to the longitudinal direction, and has a U-shaped pivot end 210 that projects into the lever chamber 11 and that has a pair of lugs 211 which confine a gap therebetween for receiving the pivot portion 241 of the coupler shaft 24 and which are formed with two opposing pivot slots 212 for extension of the pivot pin 25 therethrough. The lever 21 further has an operating end 213 that is opposite to the pivot end 210. Each of the pivot slots 212 is confined by a slot-confining wall that has a rear end generally aligned with the pin-hole 241" in the coupler shaft 24 such that the pivot pin 25 constantly abuts against the rear ends of the slot-confining walls of the pivot slots 212 by virtue of urging action of the urging member 27. The lever 21 is turnable manually about the pivot pin 25 to a first position, as best shown in FIG. 2, in which, the operating end 213 of the lever 21 abuts against the casing 10 by virtue of the urging action of the urging member 27 to prevent rearward movement of the locking plate 28 and the coupler shaft 24 from the engaging position to the disengaging position in the longitudinal direction, thereby preventing rotation of the latch member 30 via the coupler shaft 24 in the spring chamber 105. The lever 21 is turnable manually about the pivot pin 25 to a second position, in which, the operating end 213 of the lever 21 turns outwardly and forwardly of the casing 10 and the pivot end 210 of the lever 21 turns rearwardly and downwardly toward the rear wall 102, thereby permitting rearward movement of the locking plate 28 and the coupler shaft 24 from the engaging position to the disengaging position. As such, co-rotation of the coupler shaft 24 and the latch member 30 about the axis is permitted.

A connecting member 23 includes a U-shaped portion 230 which is interposed between the pivot end 210 of the lever 21 and the pivot portion 241 of the coupler shaft 24 and which permits extension of the pin 25 therethrough. A tension spring 22 is interposed between the lever 21 and the connecting member 23 in such a manner that two opposite ends of the spring 22 resiliently abut against the lever 21 and the connecting member 23 so as to prevent change of relative positions of the connecting member 23 and the lever 21 when the lever 21 turns about the pivot pin 25 between the first and second positions.

During assembly of the aforesaid conventional latch assembly, it is inconvenient and laborious to mount the coupler portion 31 of the latch member 30 on the threaded portion 242 of the coupler shaft 24 at a desired position by virtue of threaded engagement between the inner threaded face of the latch member 30 and the threaded portion 242 of the coupler shaft 24. Moreover, the nuts 33 tend to loosen after a period of use, which may result in downward turning of the latch member 30 due to gravity, thereby unlocking the recessed door.

SUMMARY OF THE INVENTION

The object of this invention is to provide a latch assembly that can overcome the drawbacks associated with the pivot art.

Accordingly, a latch assembly of the present invention is adapted to be mounted on a recessed door, and includes a casing, a coupler shaft, a latch member, a pair of nuts, a locking plate, an urging member, a pivot pin, and a lever. The casing is adapted to be fixed on the recessed door, and includes a peripheral wall defining a lever chamber and having a front open end for access to the lever chamber, and a rear wall that confines a rear side of the lever chamber. The casing further includes a spring-confining flange that projects rearwardly from the rear wall to define a spring chamber. The rear wall is formed with a shaft-extension hole in spatial communication with the spring chamber and the lever chamber. The coupler shaft extends in a longitudinal direction, is disposed movably and rotatably in the casing, and passes through the shaft-extension hole in the rear wall. The coupler shaft has a threaded portion that is disposed outwardly and rearwardly of the spring chamber, a pivot portion that extends into the lever chamber, and that is formed with a pin-hole, and a mounting portion between the threaded and pivot portions. The threaded portion has a terminating end distal from the pivot portion and formed with a pair of axially aligned grooves that extend from the terminating end toward the mounting portion of the coupler shaft. The coupler shaft is rotatable about an axis. The latch member has a coupler portion that is formed with a shaft hole for extension of the threaded portion of the coupler shaft therethrough, and that has a hole-confining wall confining the shaft hole. The coupler portion of the latch member is further formed with a pair of engaging tongues that extend inwardly and radially from the hole-confining wall and that slidably and respectively engage the axially aligned grooves in the coupler shaft so as to permit sliding movement of the latch member along the length of the coupler shaft and so as to facilitate mounting and removal of the latch member on and from the coupler shaft. The nuts are disposed at two opposite sides of the coupler portion of the latch member, and threadedly engage the threaded portion of the coupler shaft so as to secure the latch member to the coupler shaft and so as to permit co-rotation of the latch member and the coupler shaft about the axis and co-movement of the latch member and the coupler shaft in the longitudinal direction. The locking plate is fastened securely to the mounting portion of the coupler shaft for co-movement with the coupler shaft in the longitudinal direction between an engaging position, in which, the locking plate extends into the spring chamber and releasably engages the flange, thereby preventing rotation of the coupler shaft about the axis in the spring chamber, and a disengaging position, in which, the locking plate moves outwardly from the spring chamber to disengage from the flange, thereby permitting rotation of the coupler shaft about the axis. The urging member is disposed in the spring chamber for constantly urging the locking plate and the coupler shaft to move away from the spring chamber. The pivot pin is disposed in the lever chamber, and extends in a transverse direction relative to the longitudinal direction through the pin-hole in the coupler shaft. The lever extends in a vertical direction transverse to the longitudinal direction, and is disposed outwardly and forwardly of the lever chamber. The lever has a U-shaped pivot end that projects into the lever chamber and that has a pair of lugs which confine a gap therebetween for receiving the pivot portion of the coupler shaft and which are formed with two opposing pivot slots for extension of the pivot pin therethrough. The lever further has an operating end that is opposite to the pivot end. Each of the pivot slots is being confined by a slot-confining wall that has a rear end generally aligned with the pin-hole in the coupler shaft such that the pivot pin constantly abuts against the rear ends of the slot-confining walls of the pivot slots by virtue of urging action of the urging member. The lever is manually turnable about the pivot pin between a first position, in which, the operating end of the lever abuts against the casing by virtue of the urging action of the urging member to prevent rearward movement of the locking plate and the coupler shaft from the engaging position to the disengaging position in the longitudinal direction, thereby preventing rotation of the latch member via the coupler shaft, and a second position, in which, the operating end of the lever turns outwardly and forwardly of the casing and the pivot end of the lever turns rearwardly and downwardly toward the rear wall so as to permit rearward movement of the locking plate and the coupler shaft from the engaging position to the disengaging position, thereby permitting co-rotation of the coupler shaft and the latch member about the axis.

BRIEF DESCRIPTION OF THE DRAWINGS

Other features and advantages of this invention will become more apparent in the following detailed description of the preferred embodiment of this invention, with reference to the accompanying drawings, in which.

DETAILED DESCRIPTION OF THE PREFERRED EMBODIMENT

Figure 1:
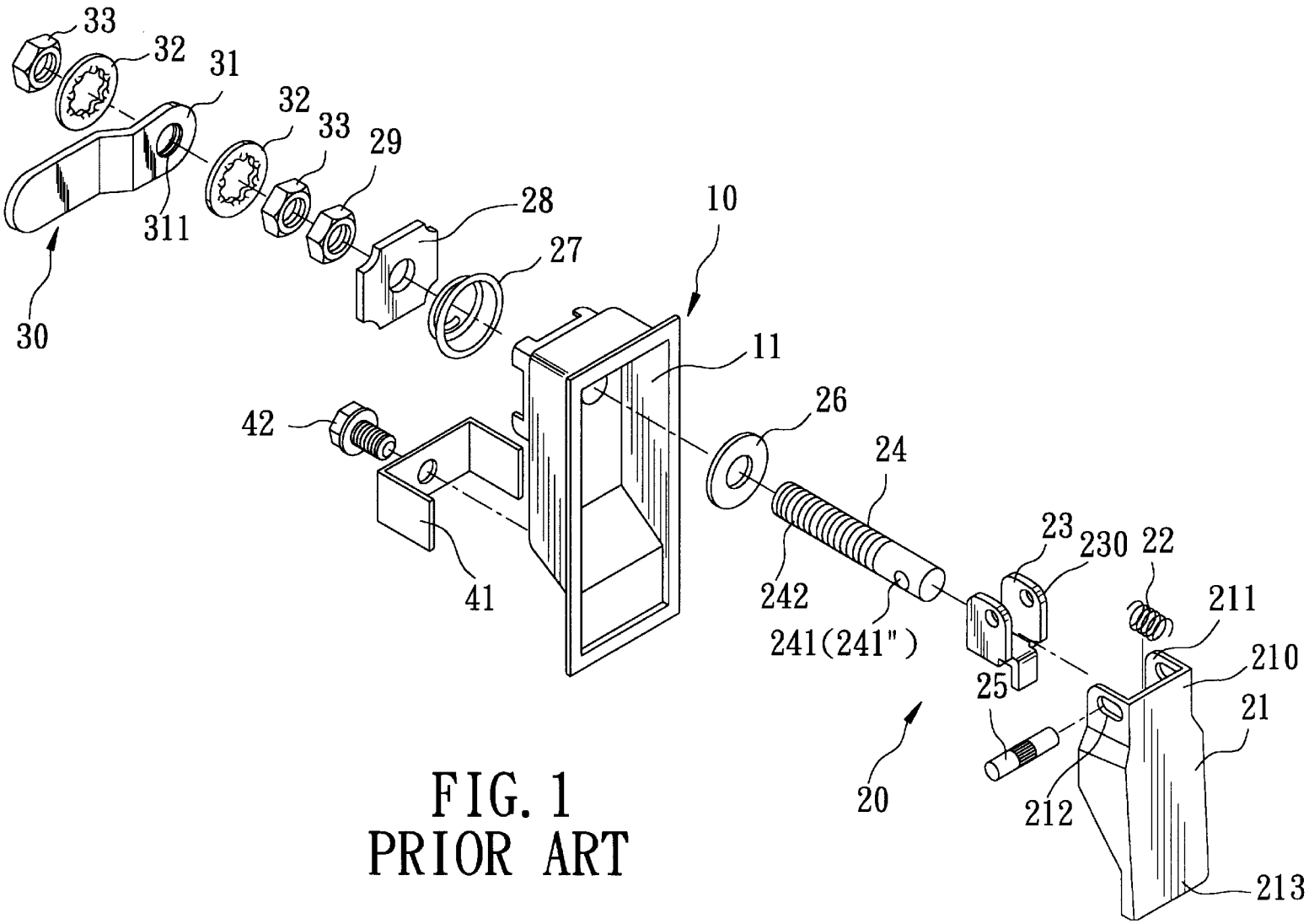
FIG. 1 PRIOR ART
FIG. 1 is an exploded perspective view of a conventional latch assembly that is adapted to be mounted on a recessed door of a cabinet for closing the same.
Figure 2:
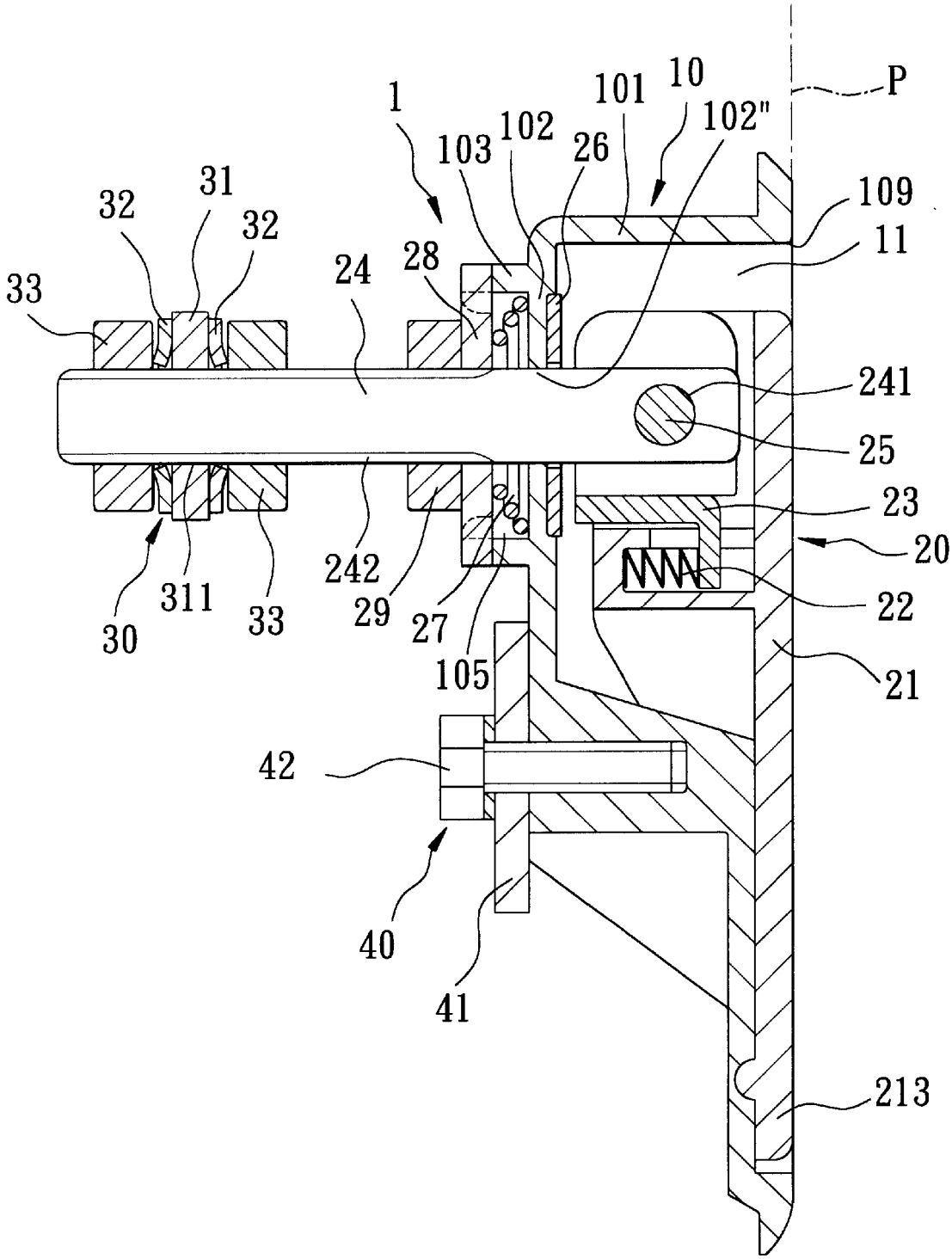
FIG. 2 PRIOR ART
FIG. 2 is a sectional view of the conventional latch assembly mounted on the recessed door.
Figure 3:
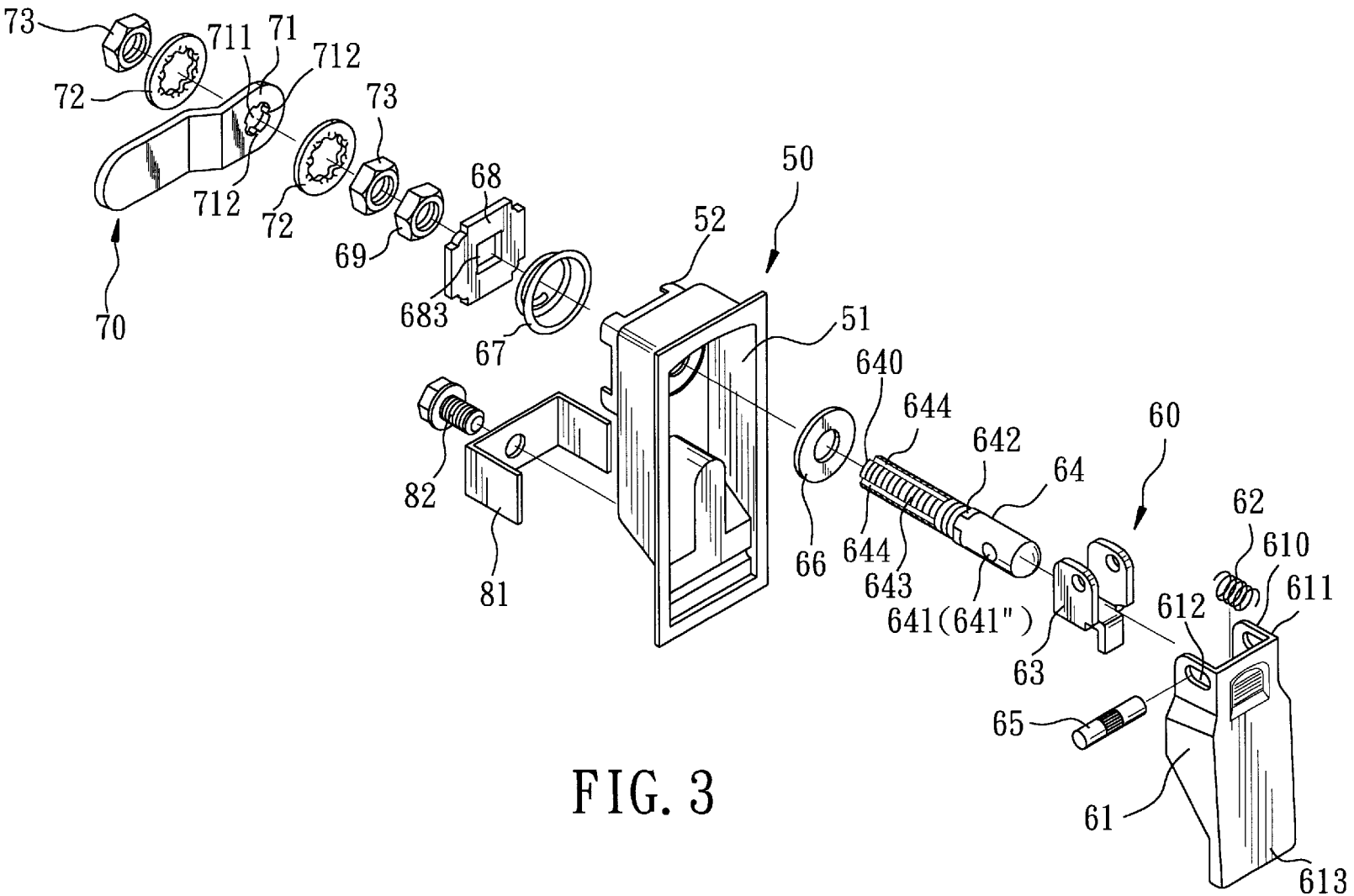
FIG. 3 is an exploded perspective view of the preferred embodiment of a latch assembly according to the present invention.
Figure 4:
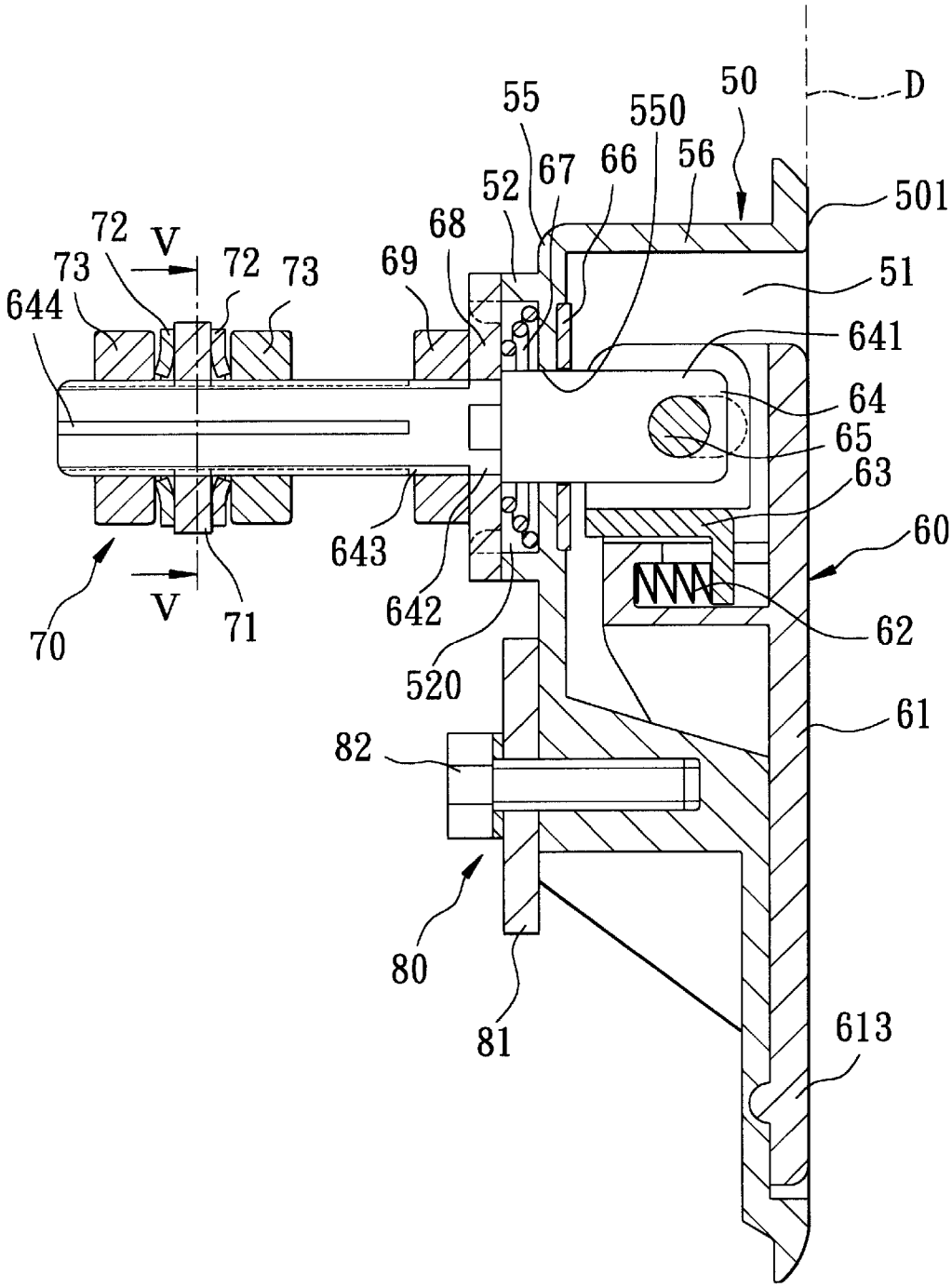
FIG. 4 is a sectional view of the preferred embodiment mounted on a recessed door of a cabinet for closing the same.
Figure 5:
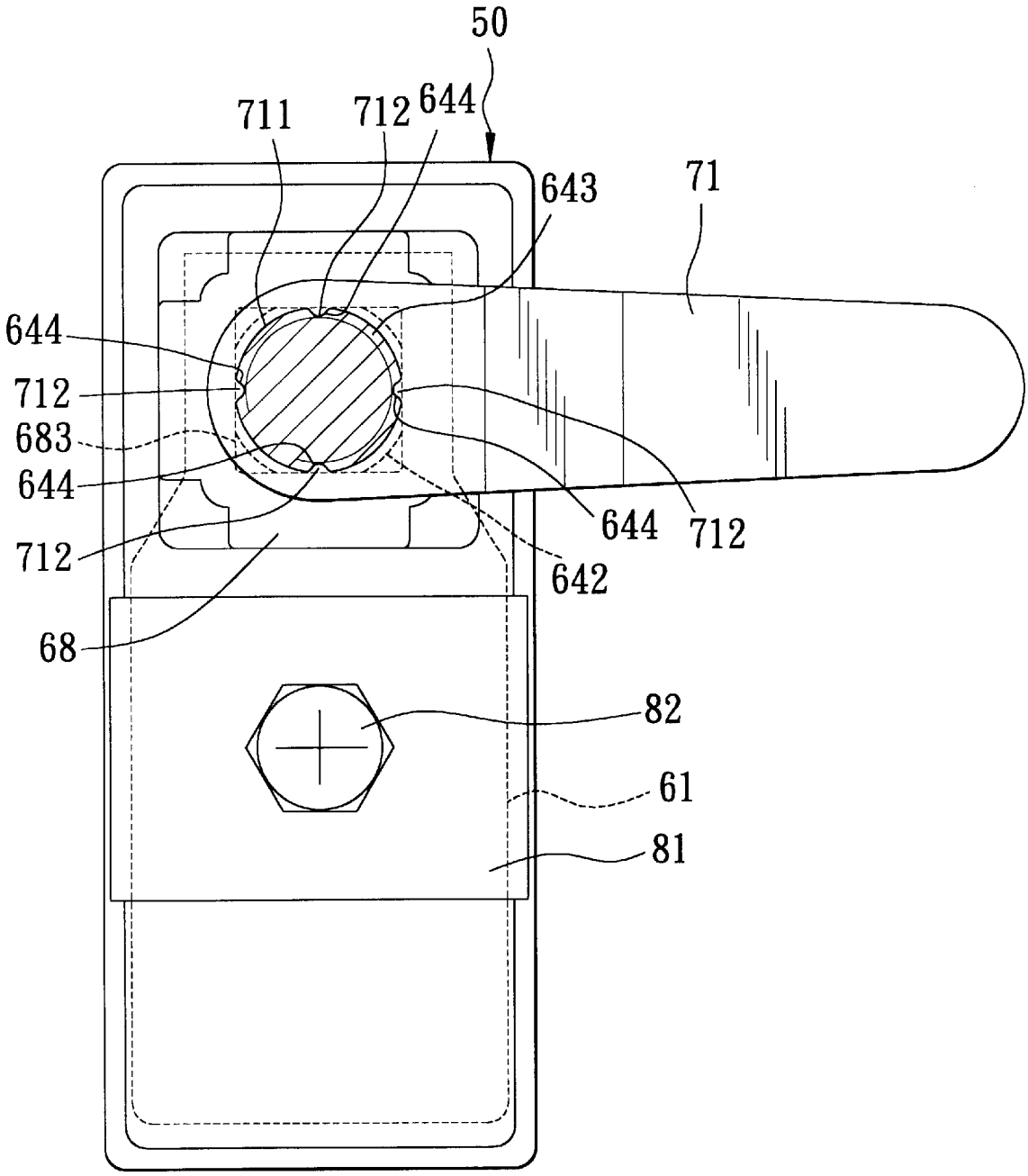
FIG. 5 is a sectional view of the preferred embodiment taken along line V—V of FIG. 4, illustrating a locking position of a latch member which prevents opening of the recessed door.

Referring to FIGS. 3 to 5, the preferred embodiment of a latch assembly of the present invention is shown to include a casing 50, a coupler shaft 64, a latch member 70, a pair of fastener nuts 73, a locking plate 68, an urging member 67, a pivot pin 65, and a lever 61.

As illustrated, the casing 50 is fixed on a recessed door D (shown by dotted lines in FIG. 4) of a cabinet (not shown) via a U-shaped bracket 81 and a fastener bolt 82, and includes a peripheral wall 56 that defines a lever chamber 51, and that has a front open end 501 for access to the lever chamber 51. The casing 50 further includes a rear wall 55 confining a rear side of the lever chamber 51, and a spring-confining flange 52 that projects rearwardly from the rear wall 55 to define a spring chamber 520. The rear wall 55 is formed with a shaft-extension hole 550 in spatial communication with the spring chamber 520 and the lever chamber 51.

The coupler shaft 64 extends in a longitudinal direction, is disposed movably and rotatably in the casing 50, and passes through the shaft-extension hole 550 in the rear wall 55. The coupler shaft 64 has a threaded portion 643 that is disposed outwardly and rearwardly of the spring chamber 520, a pivot portion 641 that extends into the lever chamber 51 and that is formed with a pin-hole 641", and a mounting portion 642 disposed between the threaded and pivot portions 643, 641. The threaded portion 643 has a terminating end 640 distal from the pivot portion 641, and formed with two pairs of axially aligned grooves 644 that extend from the terminating end 640 toward the mounting portion 642. The coupler shaft 64 is rotatable about an axis.

The latch member 70 has a coupler portion 71 that is formed with a shaft hole 711 for extension of the threaded portion 643 of the coupler shaft 64 therethrough, and that has a hole-confining wall confining the shaft hole 711. The coupler portion 71 of the latch member 70 is further formed with two pairs of engaging tongues 712 that extend inwardly and radially from the hole-confining wall and that slidably and respectively engage the grooves 644 in the coupler shaft 64 so as to permit sliding movement of the latch member 70 along the length of the coupler shaft 64 and so as to facilitate mounting and removal of the latch member 70 on and from the coupler shaft 64.

The nuts 73 are disposed at two opposite sides of the coupler portion 71 of the latch member 70 via two washers 72, and threadedly engage the threaded portion 643 of the coupler shaft 64 so as to secure the latch member 70 relative to the coupler shaft 64 and so as to permit co-rotation of the latch member 70 and the coupler shaft 64 about the axis and co-movement of the latch member 70 and the coupler shaft 64 in the longitudinal direction.

The locking plate 68 is fastened securely to the mounting portion 642 of the coupler shaft 64 for co-movement with the coupler shaft 64 in the longitudinal direction between an engaging position, in which, the locking plate 68 extends into the spring chamber 520 and releasably engages the flange 52, thereby preventing rotation of the coupler shaft 64 about the axis in the spring chamber 520, and a disengaging position, in which, the locking plate 68 moves outwardly from the spring chamber 520 to disengage from the flange 52, thereby permitting rotation of the coupler shaft 64 about the axis.

The urging member 67 is disposed in the spring chamber 520 for constantly urging the locking plate 68 and the coupler shaft 64 to move away from the spring chamber 520.

The pivot pin 65 is disposed in the lever chamber 51, and extends in a transverse direction relative to the longitudinal direction and through the pin-hole 641" in the coupler shaft 64.

Figure 6:
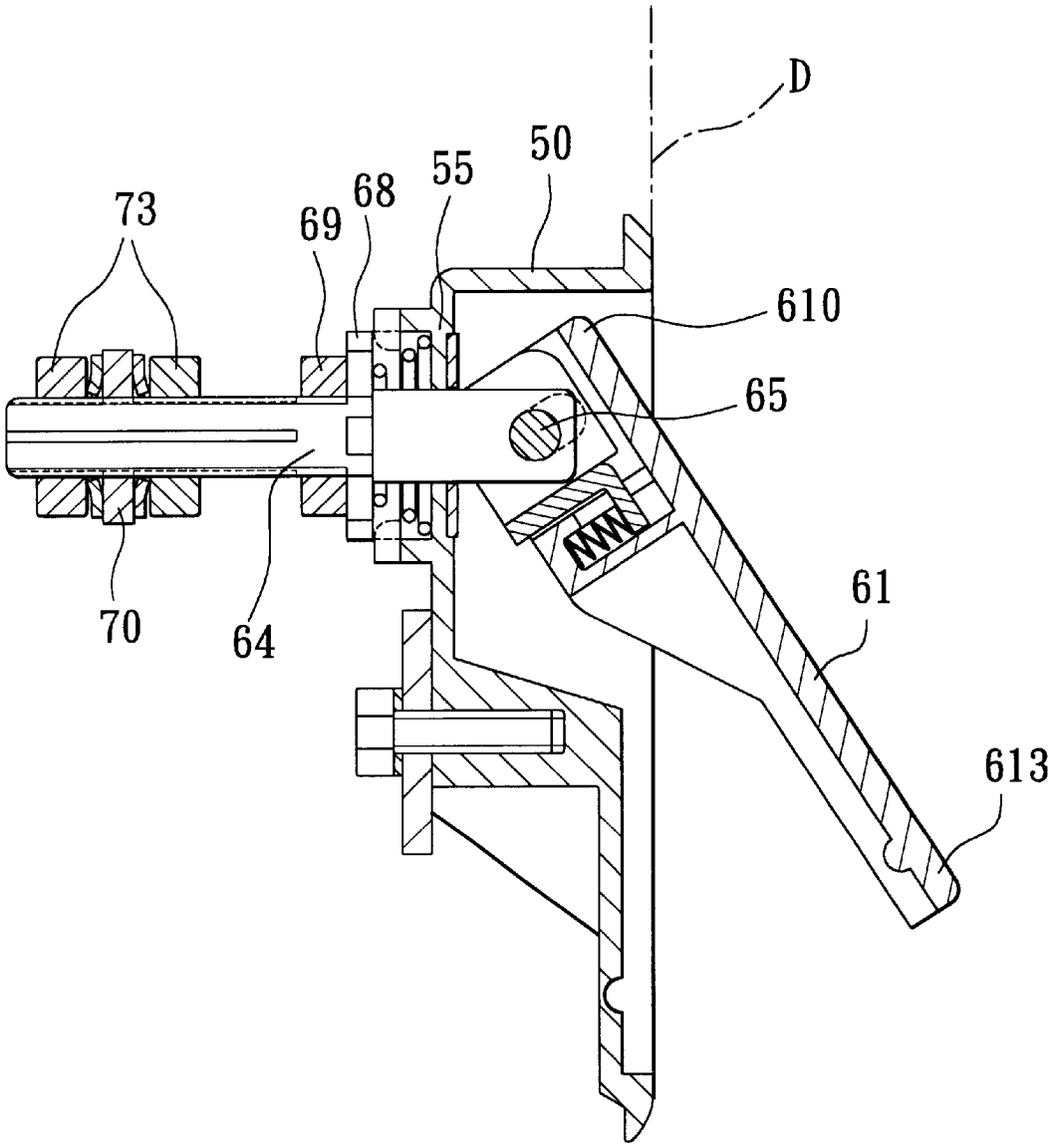
FIG. 6 is a sectional view of the preferred embodiment, illustrating a state in which a coupler shaft and the latch member can be simultaneously rotated via a lever in order to open the recessed door relative to the cabinet.
Figure 7:
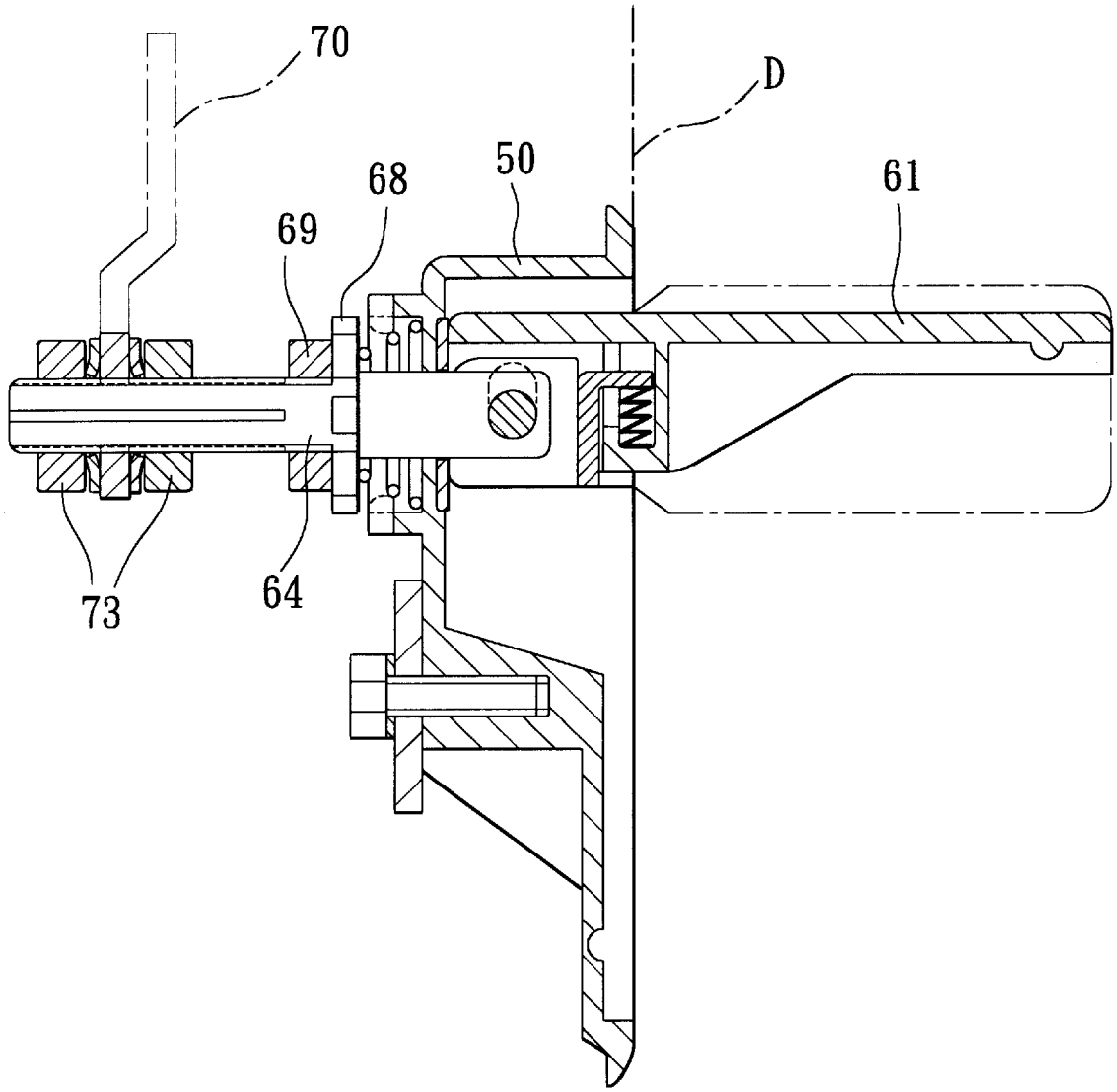
FIG. 7 is a sectional view of the preferred embodiment, illustrating a state in which the coupler shaft and the latch member are simultaneously rotated via the lever to an unlocking position.

The lever 61 extends in a vertical direction transverse to the longitudinal direction, and has a U-shaped pivot end 610 that projects into the lever chamber 51, and that has a pair of lugs 611 which confine a gap therebetween for receiving the pivot portion 641 of the coupler shaft 64 and which are formed with two opposing pivot slots 612 for extension of the pivot pin 65 therethrough. The lever 61 further has an operating end 613 that is opposite to the pivot end 610. Each of the pivot slots 612 is confined by a slot-confining wall that has a rear end generally aligned with the pin-hole 641" in the coupler shaft 64 such that the pivot pin 65 constantly abuts against the rear end of the slot-confining wall of the pivot slot 612 by virtue of urging action of the urging member 67. The lever 61 is manually turnable about the pivot pin 65 between a first position, as best shown in FIG. 4, in which, the operating end 613 of the lever 61 abuts against the casing 50 by virtue of the urging action of the urging member 67 to prevent rearward movement of the locking plate 68 and the coupler shaft 64 from the engaging position to the disengaging position in the longitudinal direction, thereby preventing rotation of the latch member 70 via the coupler shaft 64 in the spring chamber 520, and a second position, in which, the operating end 613 of the lever 61 turns outwardly and forwardly of the casing 50 and the pivot end 610 of the lever 61 turns rearwardly and downwardly toward the rear wall 55, as best shown in FIG. 6, thereby permitting rearward movement of the locking plate 68 and the coupler shaft 64 from the engaging position to the disengaging position. As such, co-rotation of the latch member 70 and the coupler shaft 64 is permitted about the axis, as best shown in FIG. 7.

In this embodiment, a fastener nut 69 is mounted threadedly on the threaded portion 643 so as to secure the locking plate 68 relative to the coupler shaft 64. The mounting portion 642 of the coupler shaft 64 has a rectangular cross section. The locking plate 68 is formed with an engagement hole 683 of a rectangular shape for fittingly receiving the mounting portion 642 so as to enhance securing of the locking plate 68 to the coupler shaft 64 and so as to permit co-rotation of the locking plate 68 and the coupler shaft 64 when the lever 61 is turned about the pivot pin 65 to the second position of FIGS. 6 and 7.

Note that a connecting member 63 is interposed between the coupler shaft 64 and the lever 61. A tension spring 62 has two opposite ends which resiliently abut against the connecting member 63 and the lever 61 in such a manner to prevent change of relative positions of the connecting member 63 and the lever 61 when the lever 61 turns about the pivot pin 65 between the first and second positions. Since the feature of the present invention does not reside in the connecting member 63, a detailed description thereof is omitted herein for the sake of brevity.

By virtue of the arrangement of the engaging tongues 712 of the latch member 70 and the grooves 644 in the coupler shaft 64, the aforesaid drawbacks as encountered in the prior art can be eliminated.

With this invention thus explained, it is apparent that numerous modifications and variations can be made without departing from the scope and spirit of this invention. It is therefore intended that this invention be limited only as indicated in the appended claims.

I claim:

1. A latch assembly adapted to be mounted on a recessed door, said latch assembly comprising:

a casing adapted to be fixed on the recessed door, and including a peripheral wall defining a lever chamber and having a front open end for access to said lever chamber, and a rear wall confining a rear side of said lever chamber, said casing further including a spring-confining flange projecting rearwardly from said rear wall to define a spring chamber, said rear wall being formed with a shaft-extension hole in spatial communication with said spring chamber and said lever chamber;

a coupler shaft extending in a longitudinal direction, disposed movably and rotatably in said casing and passing through said shaft-extension hole in said rear wall, said coupler shaft having a threaded portion that is disposed outwardly and rearwardly of said spring chamber, a pivot portion extending into said lever chamber and formed with a pin-hole, and a mounting portion disposed between said threaded and pivot portions, said threaded portion having a terminating end distal from said pivot portion and formed with at least one pair of axially aligned grooves that extend from said terminating end toward said mounting portion of said coupler shaft, said coupler shaft being rotatable about an axis;

a latch member having a coupler portion that is formed with a shaft hole for extension of said threaded portion of said coupler shaft therethrough, and that has a hole-confining wall confining said shaft hole, said coupler portion of said latch member being further formed with a pair of engaging tongues that extend inwardly and radially from said hole-confining wall and that slidably and respectively engage said axially aligned grooves in said coupler shaft so as to permit sliding movement of said latch member along the length of said coupler shaft and so as to facilitate mounting and removal of said latch member on and from said coupler shaft;

a pair of nuts disposed at two opposite sides of said coupler portion of said latch member and threadedly engaging said threaded portion of said coupler shaft so as to secure said latch member to said coupler shaft and so as to permit co-rotation of said latch member and said coupler shaft about the axis and co-movement of said latch member and said coupler shaft in the longitudinal direction;

a locking plate fastened securely to said mounting portion of said coupler shaft for co-movement with said coupler shaft in the longitudinal direction between an engaging position, in which, said locking plate extends into said spring chamber and releasably engages said flange, thereby preventing rotation of said coupler shaft about the axis in said spring chamber, and a disengaging position, in which, said locking plate moves outwardly from said spring chamber to disengage from said flange, thereby permitting rotation of said coupler shaft about said axis;

an urging member disposed in said spring chamber for constantly urging said locking plate and said coupler shaft to move away from said spring chamber;

a pivot pin disposed in said lever chamber and extending in a transverse direction relative to the longitudinal direction through said pin-hole in said coupler shaft; and a lever extending in a vertical direction transverse to the longitudinal direction, disposed outwardly and forwardly of said lever chamber, said lever having a U-shaped pivot end that projects into said lever chamber and that has a pair of lugs which confine a gap therebetween for receiving said pivot portion of said coupler shaft and which are formed with two opposing pivot slots for extension of said pivot pin therethrough, said lever further having an operating end that is opposite to said pivot end, each of said pivot slots being confined by a slot-confining wall that has a rear end generally aligned with said pin-hole in said coupler shaft such that said pivot pin constantly abuts against said rear ends of said slot-confining walls of said pivot slots by virtue of urging action of said urging member, said lever being manually turnable about said pivot pin between a first position, in which, said operating end of said lever abuts against said casing by the virtue of urging action of said urging member to prevent rearward movement of said locking plate and said coupler shaft from said engaging position to said disengaging position in the longitudinal direction, thereby preventing rotation of said latch member via said coupler shaft, and a second position, in which, said operating end of said lever turns outwardly and forwardly of said casing and said pivot end of said lever turns rearwardly and downwardly toward said rear wall so as to permit rearward movement of said locking plate and said coupler shaft from said engaging position to said disengaging position, thereby permitting co-rotation of said coupler shaft and said latch member about said axis.

2. The latch assembly as defined in claim 1, further comprising a fastener nut threadedly mounted on said threaded portion to secure said locking plate to said coupler shaft, said mounting portion of said coupler shaft having a rectangular cross section, said locking plate being formed with an engagement hole of a rectangular shape for fittingly receiving said mounting portion so as to enhance securing of said locking plate to said coupler shaft and so as to permit co-rotation of said locking plate and said coupler shaft when said lever is turned about said pivot pin to said second position.

* * * * *